US006962627B2

(12) United States Patent
Sekiguchi et al.

(10) Patent No.: US 6,962,627 B2
(45) Date of Patent: Nov. 8, 2005

(54) DEVICE FOR PROVIDING A PRESSURIZED SOLUTION TO AN APPLYING DEVICE

(75) Inventors: Takeshi Sekiguchi, Tokyo-to (JP); Shouichi Murakami, Tokyo-to (JP); Katsumi Orihara, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 10/021,393

(22) Filed: Oct. 30, 2001

(65) Prior Publication Data

US 2002/0050247 A1 May 2, 2002

(30) Foreign Application Priority Data

Oct. 31, 2000 (JP) ..... 2000-333354

(51) Int. Cl.[7] ..... B05C 11/10

(52) U.S. Cl. ..... 118/693; 118/694; 222/66; 222/65; 222/64

(58) Field of Search ..... 118/694, 693, 713, 118/683, 684, 300; 222/55, 64, 65, 66, 67

(56) References Cited

U.S. PATENT DOCUMENTS 5,383,574 A * 1/1995 Raphael ..... 222/1
5,502,685 A * 3/1996 Orlando ..... 366/132
6,245,148 B1 * 6/2001 Liang et al. ..... 118/683

* cited by examiner

*Primary Examiner*—George Koch
(74) *Attorney, Agent, or Firm*—Ladas & Parry LLP

(57) ABSTRACT

The present invention provides a providing device capable of using a solution within a tank effectively than ever as preventing an air bubble from mixing in the solution to be provided to an applying device. In providing devices and for leading a coloring sensitive matter from any one of a plurality of pressure tanks to an applying device via a predetermined flow path, middle tanks are provided every for each of pressure tanks on the way of a flow path connecting each of the plurality of pressure tanks and the applying device. A sensor detects whether an amount of a solution stored in respective middle tanks is not less than a predetermined lower limit value or not. Then, a signal in response to its result of the detection is outputted to a system controlling device. On the basis of this output signal, it is discriminated whether the amount of the solution in the middle tank is not less than the lower limit value or not. Then, if it is detected that the amount of the solution in the middle tank is less than the lower limit value, the predetermined processing in association with the switching of the pressure tank is carried out.

2 Claims, 6 Drawing Sheets

DEVICE FOR PROVIDING A PRESSURIZED SOLUTION TO AN APPLYING DEVICE

BACKGROUND OF THE INVENTION

1. Field of the Invention

The present invention relates to a device for providing solution such as a colored resin composition for a color filter, a black resin composition, a transparent resin composition, a developing fluid such as a resist material or the like, a cleaning fluid, an etching fluid and a removing fluid or the like.

2. Description of the Related Art

A coloring sensitive matter for a color filter to be used for a color display is served with being bottled in units of, for example, 10 kg and it is provided to an applying device in a pressure tank system. The pressure tank system is a system such that a bottle containing a coloring sensitive matter is arranged in a tank and the pressurized air is supplied in this tank so that the coloring sensitive matter is discharged to the exterior of the tank by its pressure.

In order to ceaselessly provide a coloring sensitive matter to the applying device, conventionally, two tanks are arranged with respect to one applying device and the tanks are used with being switched in response to the consumption ratio of the coloring sensitive matter in each tank. A remaining amount of the coloring sensitive matter in each tank is specified by detecting a weight of the tank with a weight sensor. If the weight of the tank, which has been used, is lower than a predetermined lower limit value, another tank is selected, since it is assumed that the remaining amount of the coloring sensitive matter in the tank falls short.

In the above described process for applying a coloring sensitive matter for a color filter, even if a very small air bubble mixes in, it is determined that the application fails. For example, even if only one air bubble (i.e., a micro bubble) with a diameter of about 30 $\mu$m mixes in a surface of a substrate with a size in a diagonal direction exceeds 1,000 m, it is determined that the application fails. Therefore, conventionally, a lower limit value of the weight of each tank has a sufficient margin for fear that an air bubble may mix in. Further, there is a possibility such that a detected value of a weight sensor indicates a value smaller than an actual weight, since a liquid level shakes by the oscillation of a device or the like. If the detected value of the weight sensor indicates a state that the remaining amount falls short once, a safeguard is used so that a tank has not been used unless a coloring sensitive matter is newly filled in the tank. Thus, the amount of the coloring sensitive matter, which is actually left in a bottle assumed to be short on the remaining amounts, becomes relatively large, so that great deal of the coloring sensitive matter has been uselessly thrown aside. For example, 300 to 500 cc of the coloring sensitive matter per bottle was uselessly thrown aside. Sometimes, the coloring sensitive matter more than 1 kg was uselessly thrown aside. In the case of a general base of a color filter, it is possible to color about 300 to 500 sheets with a coloring sensitive matter of 1 kg. Further, according to circumstances, it is possible to color more than 1,000 sheets with a coloring sensitive matter of 1 kg. Therefore, its improvement has been strongly desired.

SUMMARY OF THE INVENTION

Therefore, the present invention prevents an air bubble from mixing in a solution to be supplied to an applying device and an object of the present invention is to provide a providing device capable of using a solution in a tank more effectively than ever.

In order to achieve the above object, the present invention comprises a device for providing a solution which leads a solution from any one of sources of supply to an applying device via a predetermined flow path, comprising: a middle tank which is provided on the way of the flow path connecting each of the sources of supply and the applying device for each of the sources of supply; a sensor which detects whether an amount of a solution stored in each middle tank is not less than a predetermined lower limit value or not and outputs a signal in association with detection result; and a controlling device which discriminates whether the amount of the solution stored in each middle tank is not less than the lower limit value or not on the basis of the output signal from the sensor and performs the predetermined processing in association with switching of the sources of supply when it is decided that the amount of the solution stored in the middle tank is less than the lower limit value.

According to the present invention, since a middle tank is arranged in the way of a flow path connecting respective sources of supply and an applying device, even if an air bubble mixes in the flow path from the sources of supply to the middle tank, this air bubble is seized in the middle tank once and it does not immediately mix in the side of the applying device. Accordingly, it is possible to take out a solution from each source of supply as much as the remaining amount is decreased so that the air bubbles mix in the solution If the remaining amount of the solution in the source of supply is hardly left so that the solution is not supplied to the middle tank, the remaining amount of the solution in the middle tank becomes lower than the lower limit value and this state is detected by the controlling device on the basis of an output signal from a sensor. Then, a predetermined treatment in association with the switching of the sources of supply will be performed. According to a predetermined treatment, for example, the switching of the sources of supply may be indicated to an operator or a portion or the entirety of the operation to switch the sources of supply may be automatically performed. In this way, as preventing the air bubbles from mixing in the side of the applying device, it is possible to use the solution within the tank effectively. Alternatively, it is possible to use various kinds of the sources of supply, however, a source of supply in a pressure tank system is preferably used so as to pressurize the interior of the tank and take out the solution therefrom.

According to the present invention, the lower limit value of the solution to be stored in the middle tank may be appropriately set in accordance with a level to which the mixing of the air bubble in the side of the applying device is restricted. In the case that the applying device is configured so as to discharge the solution by a predetermined amount, it is preferable that a value not less than the discharged amount for one time is set as the lower limit value and more preferably, 100 to 150% of the discharged amount at one time is set as the lower limit value. It is possible to detect whether the solution is stored not less than the lower limit value or not on the basis of various physical amounts interrelated to the amount of the solution. However, it is preferable that a position of a liquid level of the solution may be detected. The middle tank may be provided with a capacity not less than the lower limit value. However, it is preferable that the capacity of the middle tank may be set higher than the lower limit value by predetermined degree of margin. More particularly, the capacity of the middle tank may be set in the range of 200 to 300% with respect to the lower limit value.

The applying device in combination with the providing device according to the present intention is configured so as to discharge the solution which is provided from the foregoing source of supply by a predetermined amount by repeatedly opening an open-close valve which closes the foregoing flow path in increments of a predetermined time. In this case, the discharged amount is changed depending on a time when an open-close valve is opened.

On the other hand, the foregoing applying device may be provided with a pump which is capable of repeating a process to take in the foregoing solution by a predetermined amount and a process to discharge the solution which is taken in. In this case, it is preferable that an ante-pump tank for storing the solution to be provided to the foregoing pump is provided between the foregoing middle tank and the foregoing pump as well as downstream of a position where the flow paths from each of middle tanks are converged, the foregoing ante-pump tank is provided with a sensor for a pump which detects whether the amount of the solution which is stored in the foregoing ante-pump tank is not less than a predetermined lower limit value or not and outputs a signal in association with its result of the detection and the foregoing controlling device discriminates whether the amount of the solution which is stored in the foregoing ante-pump tank is not less than the foregoing lower limit value or not and if the foregoing controlling device decides that the amount of the solution which is stored in the foregoing ante-pump tank is less than the foregoing lower limit value, the predetermined processing in association with the filling of the solution from the foregoing middle tank to the foregoing ante-pump tank is carried out. In this case, even if the source of supply is pressurized so as to take out the solution therefrom, it is possible to prevent the effect by the pressure to the side of a pump by absorbing the pressure in the ante-pump tank. Accordingly, it is possible to provide a providing device preferable to the case that an allowable range with respect to the unevenness of the discharge amount per once is limited to an excessively small range, whereby applying the solution with an even thickness without using the device to adjust the applying thickness such as a spin coat device or the like. Alternatively, according to the treatment in association with filling of the solution, the open-close valve of the flow path connecting the middle tank and the ante-pump tank is opened and closed. It is preferable to prohibit the filling of the solution while the pump is operating. It is because the air bubbles may be generated by the filling of the solution in the ante-pump tank and it is necessary to certainly exclude the fear that these air bubbles flow to the side of the pump.

The providing device according to the present invention is preferably used in combination with a device for applying a coloring sensitive matter, a colored resin composition, a black resin composition, a transparent resin composition and a resist material or the like to a substrate of a color filter for a color display. The coloring sensitive matter generally includes an organic solvent, so that it is preferable that the middle tank is made of a material, which can resist the organic solvent. Therefore, the middle tank may be made of a material such as a PP. (polypropylene), a glass, a PEA (polyethylene) and a Teflon (trade mark) or the like. Alternatively, the middle tank may be formed in a shape capable of holding the solution such as a tube and a container or the like. Preferably, a Teflon tube is used as the middle tank. Alternatively, the coloring sensitive matter is colored and it has photo sensitivity, so that it is preferable to use an electrostatic capacity type proximity sensor in order to detect the coloring sensitive matter in the middle tank. According to such a proximity sensor, there is no fear that the coloring sensitive matter is exposed to light from the sensor, and it is possible to detect the coloring sensitive matter without being influenced by a color thereof. Further, in the case that the middle tank is made of a Teflon tube, it is advantageous that the influence by a metal around the proximity sensor is capable of being decreased as much as possible.

DETAILED DESCRIPTION OF THE INVENTION (First Embodiment)

Figure 1:
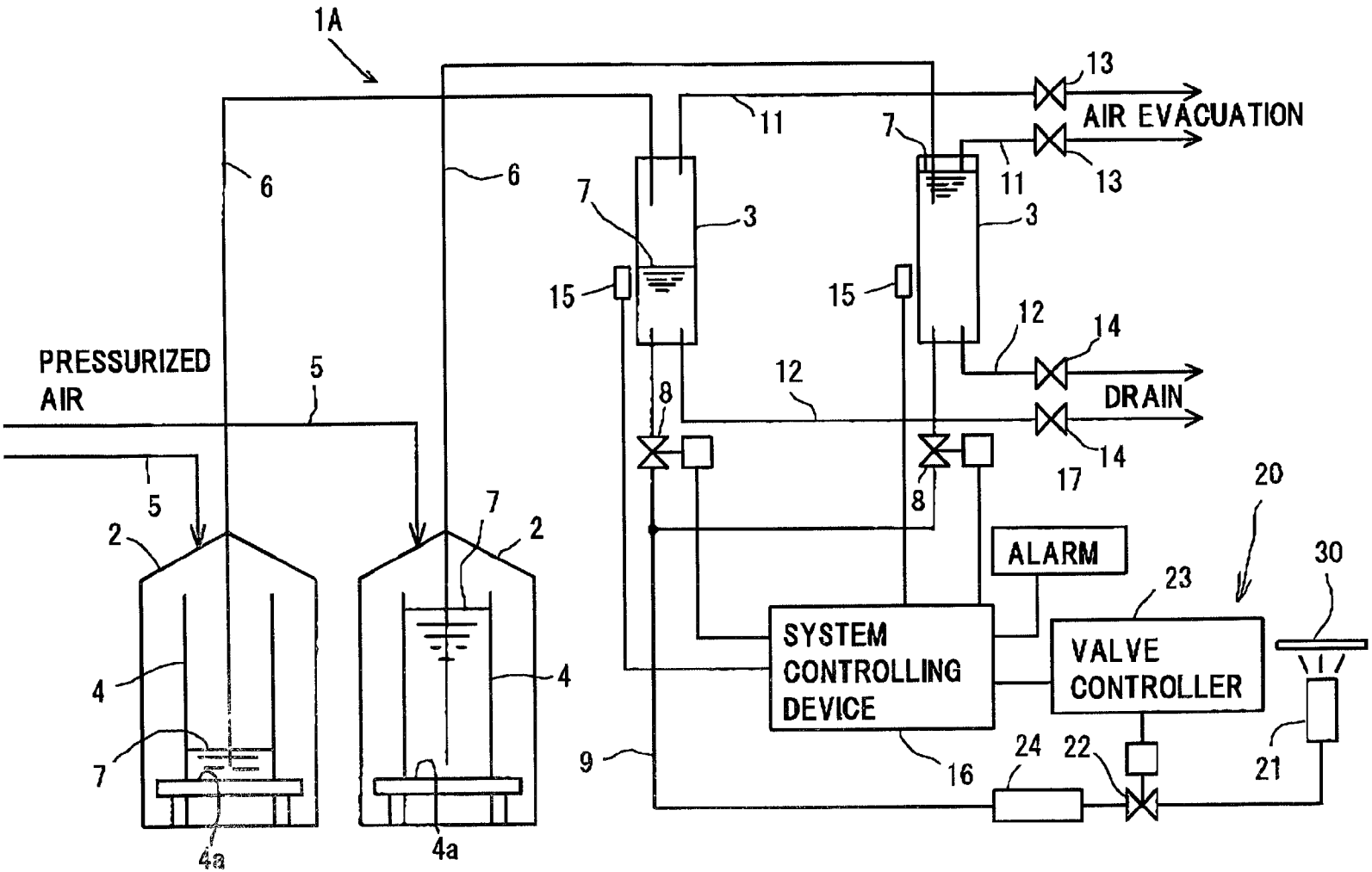
FIG. 1 is a view for illustrating a constitution of a providing device according to a first embodiment of the present invention.

FIG. 1 illustrates a first embodiment of a providing device according to the present invention. This providing device 1A serves to provide a coloring sensitive matter for a color filter to an applying device 20. The providing device 1A is provided with two pressure tanks 2 as a source of supply and middle tanks 3 which are provided in association with respective pressure tanks 2 one-to-one. In the interior of each pressure tank 2, a bottle 4 of the coloring sensitive matter is provided. The interiors of the pressure tanks 2 are pressurized to a predetermined pressure (for example, 0.1 to 0.5 M.P) by the air, which is supplied from respective pressure lines 5. One end of a primary line 6 connecting each of the pressure tanks 2 and each of the middle tanks 3 is inserted in the vicinity of the bottom of the bottle 4, which is arranged within the pressure tank 2, and, owing to the pressurization of the tank 2, a coloring sensitive matter 7 within the bottle 4 is supplied to the middle tank 3 via the primary line 6.

Figure 2:
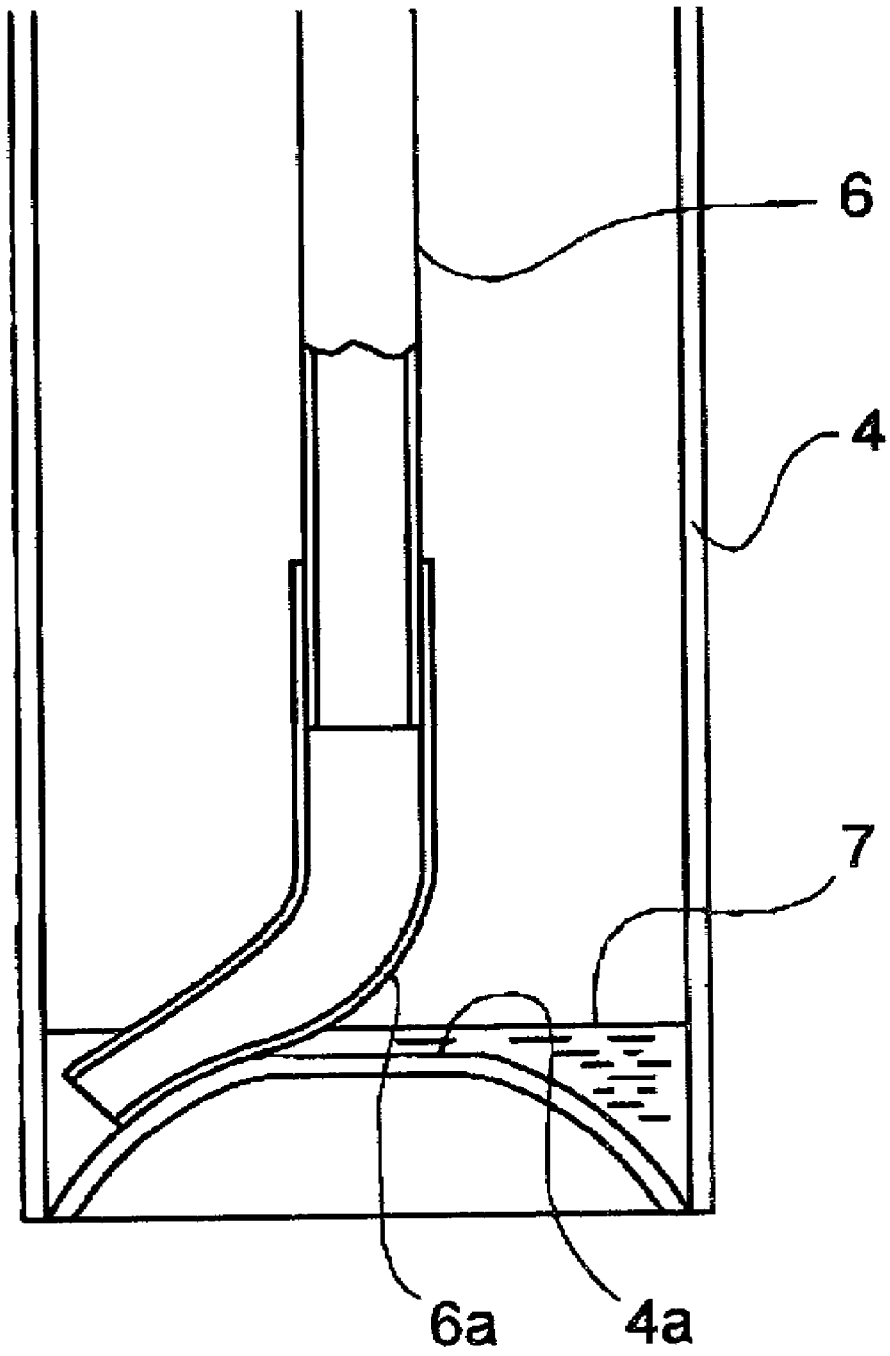
FIG. 2 is a view for illustrating an appearance of a bottle bottom, which is arranged in a pressure tank shown in FIG. 1.

In order to decrease the amount of the coloring sensitive matter 7 left in the bottle 4, it is preferable that an inlet of the primary line 6 is close to a bottom 4*a* of the bottle 4 as much as possible. As shown in FIG. 2, in the case that the bottom 4*a* of the bottle 4 is formed in a spherical shape which is founded toward a center, it is preferable that at least end portion of the primary line 6 is configured by a flexible tube (for example a Teflon tube) 6*a* so that the primary line 6 can reach the lowest portion of the bottom 4*a* of the bottle 4. The same applies to a case that the center of the bottom 4*a* becomes lowest.

As shown in FIG. 1, below the respective middle tanks 3, there are provided open-close valves 8, 8 of an electromagnetic control system. Secondary lines 9 connecting the middle tanks 3 and the applying device 20 converge downstream of the open-close valves 8 thereof to communicate through the applying device 20. If each open-close valve 8 is closed, it becomes impossible to provide the coloring sensitive matter 7 from the interior of each middle tank 3 to the applying device 20. As a result, the coloring sensitive matter 7 is stored in the middle tank 3. Thus, the middle tank system is configured by the combination of the middle tanks 3 and the open-close valves 8. If any one of the open-close valves 8 is opened, it becomes possible to provide the coloring sensitive matter 7 from the interior of the middle tank 3 to the applying device 20. Alternatively, an air evacuation line 11 is connected to an upper end of each of the middle tanks 3 and a drain line 12 is connected to a lower end thereof. In the same way, open-close valves 13 and 14 are attached to respective lines 11 and 12.

The applying device 20 is provided with a nozzle (or referred to as a head) 21 which applies the coloring sensitive matter 7 lead from the middle tank 3 to a substrate 30 of a color filter, an open-close valve 22 of an electromagnetic control system, which changes over from the supply of the coloring sensitive matter 7 to the nozzle 21 to the stop thereof, and a valve controller 23 which controls opening and closing of the open-close valve 22. Alternatively, upstream of the open-close valve 22, an air vent tank 24 is arranged to thereby function as a buffer for releasing the air mixed in the secondary line 9.

If the open-close valve 22 in the applying device 20 is opened when in a state that any one of a pair of open-close valves 8, 8 in the providing device 1 is opened and other one thereof is closed, a flow path communicates from any one of the pressure tanks 2 to the nozzle 21 through the middle tank 3 and the coloring sensitive matter 7 with the flow rate in proportion as a time during the open-close valve 22 has been opened is discharged from the nozzle 21. The substrate 30 is being fed at a predetermined speed in parallel with a surface to be applied with the coloring sensitive matter 7 and a valve controller 23 repeatedly opens and closes the open-close valve 22 at a predetermined period in synchronization with the feeding speed of the substrate 30. The time for opening the open-close valve 22 is fixed for each time. Accordingly, a specific quantity of the coloring sensitive matter 7 is discharged from the nozzle 21 for each time. Alternatively, in FIG. 1, the nozzle 21 is drawn upward, however, the nozzle 21 may be arranged downward or sideways.

Sensors 15 for monitoring the positions of the liquid levels of the coloring sensitive matters 7, which are left in respective middle tanks 3, are attached to respective middle tanks 3. The sensor 15 comprises an electrostatic capacity type proximity sensor to detect a distance between the sensor 15 and an object to be detected in non-contacting state by using the change in the electrostatic capacity in association with the change of the distance between the object to be detected and the sensor 15. In this case, considering the electrostatic capacity between the sensor 15 and the middle tank 3 is changed depending on whether the liquid level of the coloring sensitive matter 7 is higher than a position where the sensor 15 is arranged (on the basis of a detection position of the sensor) or not, the output signal from the sensor 15 is lead to the system controlling device 16 and the system controlling device 16 discriminates whether the liquid level of the coloring sensitive matter 7 in the middle tank 3 is not lower than a predetermined lower limit vale or not. As such an electrostatic capacity type proximity sensor, for example, a proximity sensor of E2K-F type served by OMRON CORPORATION can be used.

The lower limit position of the liquid level of the coloring sensitive matter 7 to be monitored by the sensor 15 is set at the same position as or higher than the liquid level when the coloring sensitive matter 7 is stored in the middle tank 3 by a quantity as much as that of the discharge amount when the open-close valve 22 of the applying device 20 is opened once. In other words, the lower limit value of the coloring sensitive matter 7 to be stored in the middle tank 3 is set not lower than the discharge amount that the applying device 20 discharges once. This lower limit value may be appropriately set in response to the kinds of the solution to be applied. However, in the case that the coloring sensitive matter 7 with the viscosity range of 3.7±1 to 24±1.5 cp is used, it is preferable that 100 to 150% of the discharge amount of the coloring sensitive matter 7 by the applying device 20 for one time is set as the lower limit value of the coloring sensitive matter 7 to be stored in the middle tank 3. The discharge amount of the coloring sensitive matter 7 by the applying device 20 for one time is typically 30 to 50 cc, however, its value may be different depending on the size and the kind of the substrate 30 or a required limit level of an air bubble. Alternatively, in the case that there is a liquid amount which is not capable of being taken out from the middle tank 3 to the line 9 owing to a circumstance of a connecting portion of the middle tank 3 and the line 9 or the like, the amount except for this is treated as the amount of the coloring sensitive matter 7 stored in the middle tank 3.

The entire capacity of the middle tank 3 may be enough if it is capable of receiving the coloring sensitive matter 7 not lower than the above described lower limit value. However, it is preferable that the capacity not less than 200 to 300% of the capacity which is set as the lower limit value is stored in the middle tank 3. The middle tank 3 may be made of various materials. However, it is preferable that the middle tank 3 is made of a material such that the operator is capable of confirming the existence of the coloring sensitive matter 7 visually. From this point, it is preferable that the middle tank 3 is made of a Teflon tube with transparency.

Alternatively, the sensor 15 is preferably arranged to so that the height thereof is capable of being adjusted in the vertical direction. In this case, for example, a position adjusting mechanism is constructed in such a manner that rails are provided in the vertical direction and the sensor 15 is fixed to an arbitrary position on these rails. In other than this, the height of the sensor 15 may be adjusted by various constructions.

Figure 3:
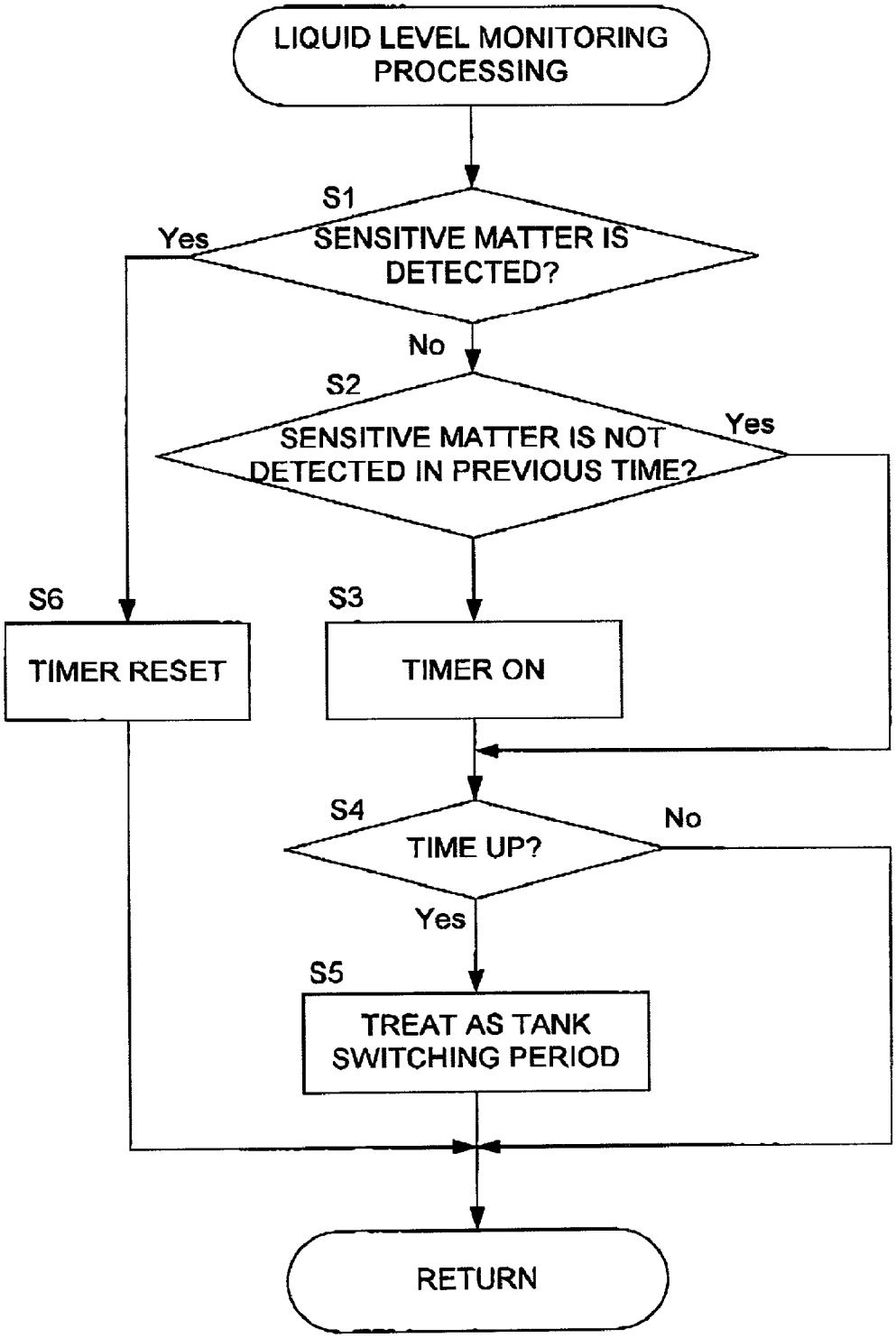
FIG. 3 is a flow chart for illustrating a procedure of a liquid level monitoring processing to be performed by a system control device shown in FIG. 1.

It is possible to configure the system controlling device 16, for example, as a computer in combination with a microprocessor, a memory necessary for the operation of the microprocessor, a clock circuit and other peripheral circuits. The system controlling device 16 performs the processing to monitor the liquid level of respective middle tanks 3 on the basis of the output signals from the sensors 15. Further, in the case that the lowering of the liquid level is detected, the system controlling device 16 performs the predetermined processing related to the switching of the pressure tanks 2. FIG. 3 is a flow chart for illustrating a procedure of this liquid level monitoring processing. The procedure for providing the coloring sensitive matter 7 by the providing device 1 will be explained with reference to FIG. 3 below.

According to the above described providing device 1, in the beginning of the operation, a new bottle 4, namely, a bottle 4 filled with the coloring sensitive matter 7 is arranged in each pressure tank 2. Then, the open-close valve 8 at the lower end of the middle tank 3, which is connected to each of the pressure tanks 2, is closed, so that the coloring sensitive matter 7 is filled approximately to the upper end of each of the middle tanks 3. After that, in a state that any one of the open-close valves 8 is opened and other one of the open-close valves 8 is closed, the application of the coloring sensitive matter 7 by use of the opening and closing of the open-close valves 22 is started. If the operation is started, the system controlling device 16 repeatedly performs the liquid level monitoring processing shown in FIG. 3 at a predetermined period.

According to this processing, first of all, it is detected whether the sensor 15 (however, it is assumed that the sensor 15 is located at the side of the middle tank 3, which is selected as an object to be provided with the coloring sensitive matter 7 at the present) detects the coloring sensitive matter 7 or not (step S1). If the coloring sensitive matter 7 is detected, a timer is reset (step S6) and the monitoring processing for one time is terminated. If the application of the coloring sensitive matter 7 proceeds and the coloring sensitive matter 7 within the bottle 4 is nearly wasted, the primary line 6 absorbs the air and the air flows into the middle tank 3, so that the liquid level of the coloring sensitive matter 7 within the middle tank 3 is lowered. Then, if the liquid level of the coloring sensitive matter 7 is lowered than the lower limit value, the step S1 is determined negatively as the output signal of the sensor 15 is changed, so that the sensor 15 is not capable of detecting the coloring sensitive matter 7. In this case, in the system controlling device 16, it is determined whether the sensor 15 is not capable of detecting the coloring sensitive matter 7 also in the former monitoring processing or not (step S2). If it is determined that the sensor 15 detects the coloring sensitive matter 7 in the former processing, a timer is activated and the clocking of a duration time that the coloring sensitive matter 7 has been not detected is started (step S3). If it is determined that the sensor 15 does not detect the coloring sensitive matter 7 in the former processing, the step S3 is skipped. After that, it is determined whether the clocking by the timer reaches a predetermined time (for example, 0.1 to 0.5 seconds) or not (step S4). Then, if it is determined that the clocking by the timer does not reach the predetermined time, the monitoring processing which has currently been performed is terminated.

In this case, it is required for advancing the processing to step S5 from step S4 that the sate in which the coloring sensitive matter 7 is not detected has been maintained for some period. Such condition is provided by considering the following circumstances. Namely, the sensor 15 may momentarily output a signal indicating that the coloring sensitive matter 7 is not detected even though the liquid level of the coloring sensitive matter 7 is not lowered than the lower limit value, due to the shaking of the liquid level or the temporally mixing of an air bubble in the middle tank 3. In such case, there is a fear that the coloring sensitive matter 7 is wastefully thrown away. Therefore, it is required to provide means for avoiding such waste due to such a transitional factor. However, that period may be appropriately determined in response to the operational state of the device or the like.

On the other hand, in the case that the clocking by the timer reaches a predetermined tine (i.e., time up), it is regarded as a time to switch the pressure tank 2 has come. Then, the predetermined controlling processing is performed in relation to switching of the pressure tank 2, so that the monitoring processing is terminated.

As the processing to be performed with the step S5 as a trigger, for example, there is the processing such that the open-close valve 8, in which the lowering of the liquid level is detected, is closed while the open-close valve 8 of the opposite side is opened. By an alarm 17 shown in FIG. 1, the operator may be instructed to switch the pressure tank 2. Alternatively, since the middle tank 3 has a margin more than the discharged amount, the operator may discontinue the switching of the tank 2 until the application operation is terminated, while a signal to indicate a tank switching period is outputted to the valve controller 23 to thereby make the valve 22 close after terminating the application operation.

Alternatively, besides the switching of the open-close valve 8, as processing in accordance with the switching of the tank 2, there is processing such that the used bottle 4 is wasted and a new bottle 4 is set to fill the coloring sensitive matter 7 in the middle tank 3, so that the middle tank 3, in which the lowering of the liquid level is detected, can be used again. This operation may be performed by the operator of the device 1 by a manual labor, or a portion or the entirety thereof may be automatically controlled by the system controlling device 16. Alternatively, it is necessary to open the open-close valve 13 of the air evacuation line 11 in order to fill the middle tank 3 in which the lowering of the liquid level is detected with the coloring sensitive matter 7 again. However, the operator may open and close the open-close valve 13 of the air evacuation line 11 by a manual labor, or the system controlling device 16 may automatically control it. Assuming that the switching of the open-close valve 8 or the like is entirely performed by a manual labor, the operator may be simply instructed that a timing of switching the tank has come by the alarm 17 or the like in the step S5.

In the same way, the pressure tank 2 is switched every when the lowering of the liquid level is detected by the sensor 15, so that it is possible to provide the coloring sensitive matter 7 alternately from the two pressure tanks 2 to the applying device 20. Further, the coloring sensitive matter 7 more than the discharge amount for one time is left in the middle tank 3 in the stage such that the lowering of the liquid level of the middle tank 3 is detected by the sensor 15, so that, even if the coloring sensitive matter 7 is taken out until the air bubble mixes in from the bottle 4, this air bubble is seized in the middle tank 3 so that the air bubble does not mix in the applying device 20. Accordingly, it is possible to use the coloring sensitive matter 7 within respective bottles 4, which are arranged in respective tanks 2, more effectively than ever.

(A Second Embodiment)

Figure 4:
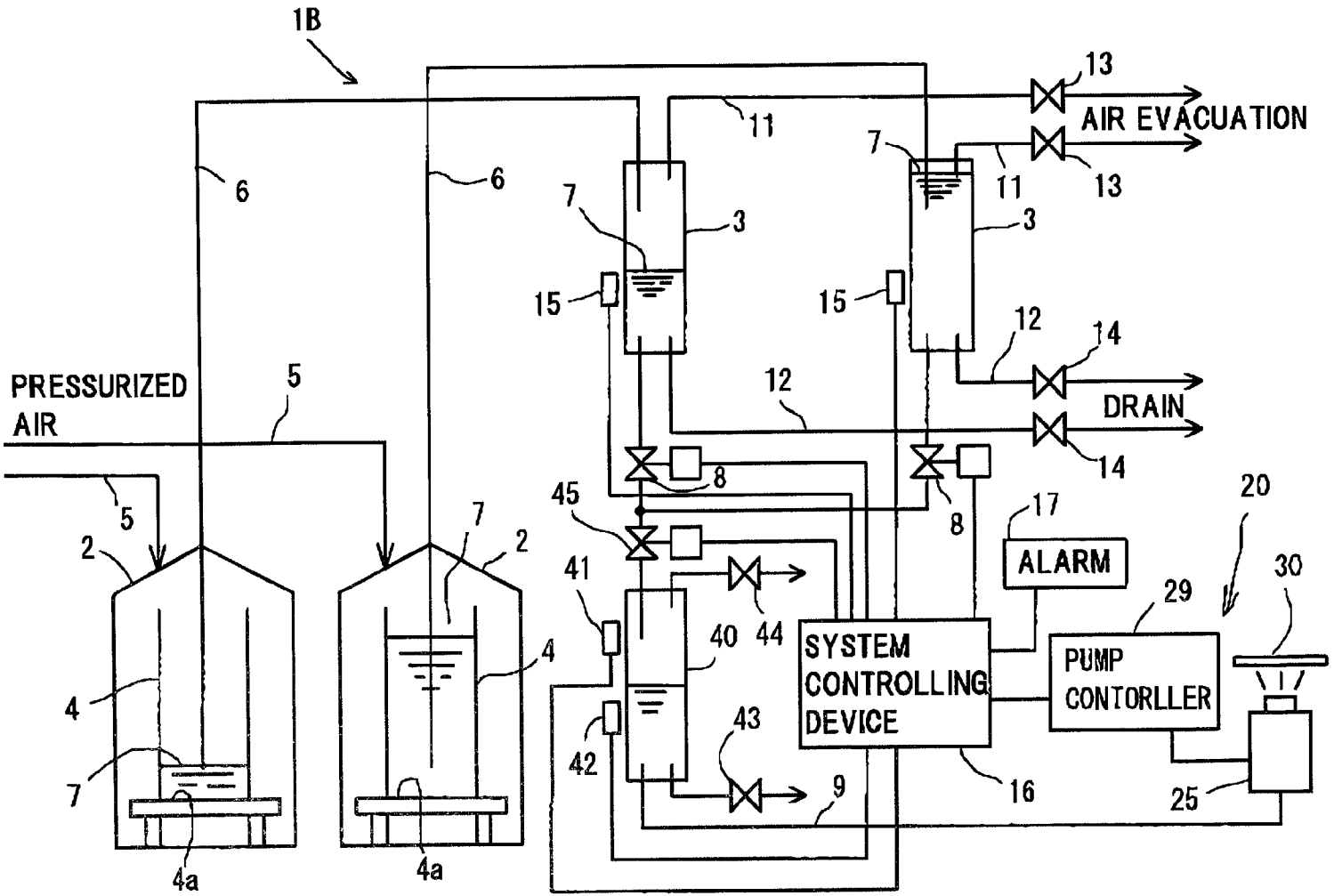
FIG. 4 is a view for illustrating a constitution of a providing device according to a second embodiment of the present invention.

FIG. 4 is a view for illustrating a providing device 1B according to a second embodiment of the present invention. In FIG. 4, the identical reference numerals are given to the identical parts in FIG. 1 and mainly, with respect to the different parts, the explanation will be given below. The providing device 1B shown in FIG. 4 is different from the providing device 1A shown in FIG. 1 in that it is directed to the applying device 20 provided with a pump 25 and an ante-pump tank 40 is arranged in the way of the secondary line 9 connecting the middle tanks 3 and the applying device 20 in response to the arrangement of the pump 25.

Figure 5:
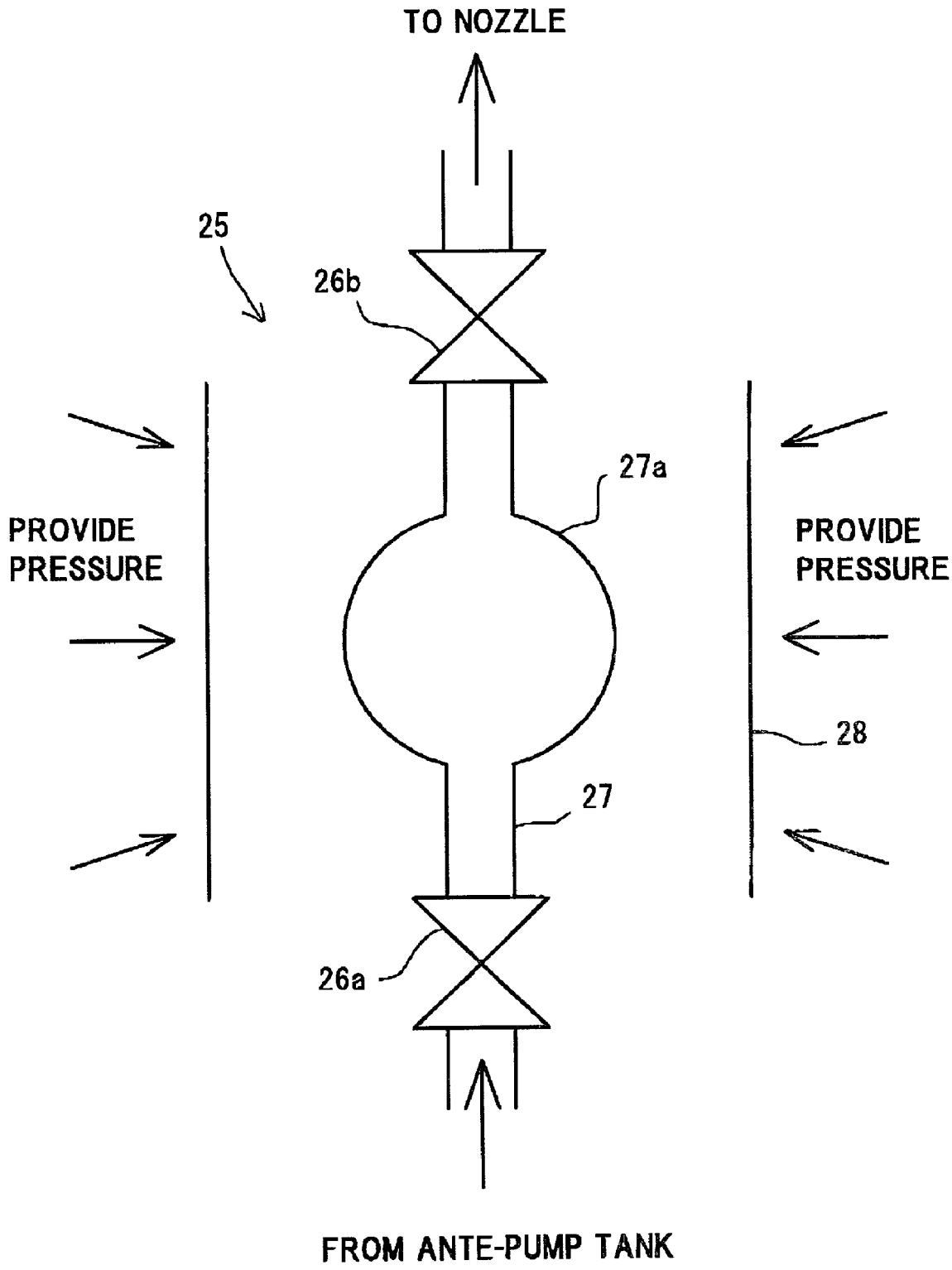
FIG. 5 is a view for illustrating a constitution of a pump to be used by an applying device shown in FIG. 4.

As shown in FIG. 5, the pump 25 is provided with a pair of open-close valves 26*a* and 26*b*, a pump tube 27 having a pump chamber 27*a*, which is located between the pair of open-close valves 26*a* and 26*b*, and a pressure tube 28, which is arranged in the outer periphery of the pump tube 27. The pump tube 27 is connected to the ante-pump tank 40 through the secondary line 9. The pressure tube 28 is arranged so that it surrounds the pump chamber 27*a* of the pump tube 27 in airtight condition and the pressure of the fluid is added to the outside of the pressure tube 28. Accordingly, by increasing and decreasing the pressure to be added from the outside of the pressure tube 29, the pressure to be added to the pump chamber 27*a* is changed and the pump chamber 27*a* is contracted and expanded. In response to these contraction and expansion, the open-close valves 26*a* and 26*b* are opened and closed, so that the coloring sensitive matter 7 is taken into the pump chamber 27*a* and the coloring sensitive matter 7 is discharged from the pump chamber 27*a*.

In the case that the pump chamber 27*a* is once contracted and then expanded in a state that the open-close valve 26*a* is opened and the open-close valve 26*b* is closed, the coloring sensitive matter 7 is taken into the pump chamber 27*a*. On the other hand, in the case that the pump chamber 27*a* filled with the coloring sensitive matter 7 is contracted when the open-close valve 26*a* is closed and the open-close valve 26*b* is opened, the coloring sensitive matter 7 in the pump chamber 27*a* is discharged therefrom and sent to a nozzle (not illustrated). In this way, the pump 25 repeats a process to take in the coloring sensitive matter 7 with a fixed capacity and a process to discharge the coloring sensitive matter 7, which is taken in. These operations are controlled by the pump controller 29 in synchronization with the conveyance operation of the substrate 30. Since the above described applying device 20 shown in FIG. 1 discharges the coloring sensitive matter 7 from the nozzle 21 by use of the pressure which is provided from the pressure tank 2, the discharge amount is subtly changed under the influence of the variance of the pressure. However, in the case of using the pump 25 shown in FIG. 5, the coloring sensitive matter 7 with a fixed amount is stored in the pump chamber 27*a* to be discharged therefrom, so that it is possible to repeatedly apply the coloring sensitive matter 7 with a fixed amount to the substrate 30 without being influenced by the variance of the pressure of the pressure pump 2. Accordingly, the pump 25 is suitable for coloring the substrate 30 without using the spin coating process.

On the other hand, the ante-pump tank 40 shown in FIG. 4 is provided in order to store the coloring sensitive matter 7 to be provided to the pump chamber 27*a*. The ante-pump tank 40 is also capable of being made of, for example, a Teflon tube as same as the middle tank 3. Alternatively, the middle tanks 3 are provided with respect to the pressure tanks 2 by one-to-one correspondence. However, one ante-pump tank 40 maybe provided with respect to a plurality of middle tanks 3. In order to monitor the amount of the coloring sensitive matter 7 stored in the ante-pump tank 40, the ante-pump tank 40 is also provided with sensors 41 and 42. The sensor 41 detects the upper limit of the liquid level of the ante-pump tank 40 and the sensor 42 detects the lower limit of the liquid level of the ante-pump tank 40. As these sensors 41 and 42, the electrostatic capacity type proximity sensor can be preferably used as same as the sensor 15 of the middle tank 3.

The lower limit of the liquid level, which is detected by the sensor 42, is the same as the lower limit of the liquid level, which is detected by the sensor 15 of the middle tank 3. In other words, the detection position of the sensor 42 is set so that the coloring sensitive matter 7 not less than the discharge amount for one time by the pump 25 is left in the ante-pump tank 40 when the sensor 42 outputs a signal to indicate the lowering of the liquid level.

Alternatively, an open-close valve 43 for a drain and an open-close valve 44 for the air evacuation are connected to the ante-pump tank 40, respectively, as same as the middle tank 3. Between a position where the flow paths in the downstream side of the open-close valves 8 are converged and the ante-pump tank 40, further another open-close valve 45 is provided. This open-close valve 45 is provided as the device to close the flow path communicating from the middle tank 3 to the ante-pump tank 40 in addition to the open-close valve 8.

According to the providing device 1B which is configured as described above, if the lowering of the liquid level of the coloring sensitive matter 7 is detected by the sensor 15 of the middle tank 3, the processing in association with the switching of the tank 2 is performed by the system controlling device 16 as same as the providing device 1A shown in FIG. 1. Alternatively, if the lowering of the liquid level of the middle tank 3 is detected by the sensor 15, the open-close valve 8 in response to that middle tank 3 is closed. Prior to this closing operation (less than one second as a time), the open-close valve 45 is closed by the system controlling device 16. Therefore, it is possible to certainly prevent the air bubble from mixing in the ante-pump tank 40. Alternatively, when the open-close valve 8 gets out of order, the open-close valve 45 can be used as the device to close the flow path connecting the middle tank 3 and the ante-pump tank 40 in place of the open-close valve 8. Further, in the case that the open-close valve 8 is opened for the maintenance such as cleaning of the pressure tank 2 and the middle tank 3 or the like, it is possible to use the open-close valve 45 as the device to detach the ante-pump tank 40 side from the side of the middle tank 3.

Figure 6:
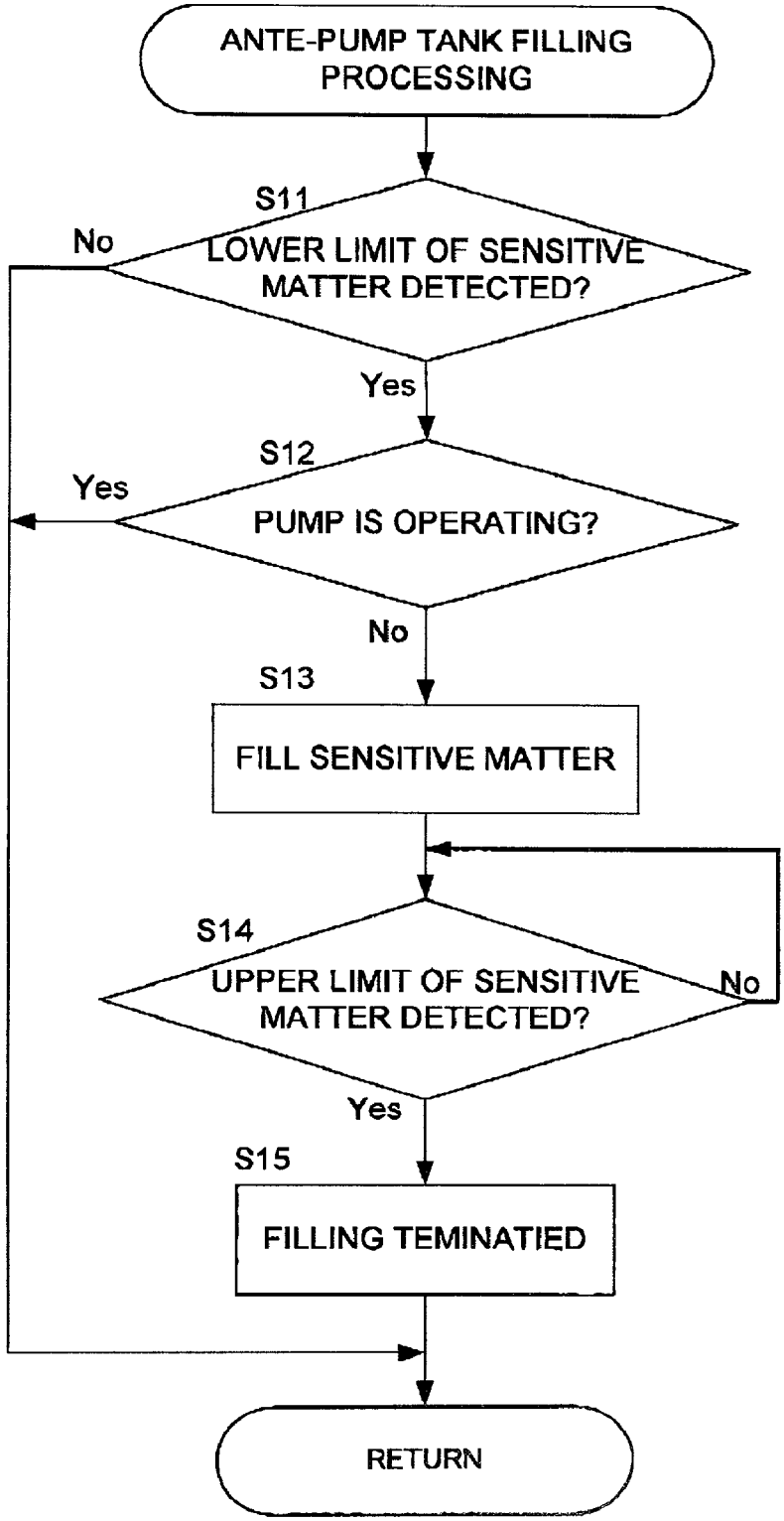
FIG. 6 is a flow chart for illustrating a procedure of processing to fill a tank in front of a pump to be performed by a system control device shown in FIG. 4.

In parallel with the control in accordance with the detection of the lowering of the liquid level with respect to the middle tank 3, the system controlling device 16 repeatedly performs the filling processing of the ante-pump tank shown in FIG. 6 at a predetermined period. According to the processing shown in FIG. 6, first of all, on the basis of the output signal of the sensor 42, it is decided whether the level of the coloring sensitive matter 7 within the tank 40 reaches the lower limit or not (step S11). If the level of the coloring sensitive matter 7 is discriminated as the lower limit, it is decided whether the pump 25 is operating or not (step S12). In order to enable such determination, for example, a signal to discriminate whether the pump 25 is operating or not may be outputted from the pump controller 29 to the system controlling device 16.

If the pump 25 is not operating, any one of the open-close valves 8 of the middle tanks 3 is opened and the coloring sensitive matter 7 is filled in the ante-pump tank 40 (step S13). The open-close valve 8, which is opened at this time, corresponds to the pressure tank 2, which has been used at the present. The filling the coloring sensitive matter 7 has been continued until the sensor 41 detects the upper limit of the liquid level (step S14). Then, if the upper limit value is detected, the open-close valve 8 is closed and the filling is terminated (step S15). Alternatively, if the open-close valve 44 for the air evacuation is also configured so as to be opened in association with the filling of the coloring sensitive matter 7, it is possible to smoothly fill the coloring sensitive matter 7. Additionally, by opening the open-close valve 44 for the air evacuation upon filling the coloring sensitive matter 7, it is possible to release the pressure of the pressure tank 2 from the ante-pump tank 40, so that the influence of the pressure to the side of the pump 25 is prevented and the stable discharged amount is capable of being obtained.

In the case that it is discriminated that the liquid level is not the lower limit in step S11, or in the case that it is discriminated that the pump 25 is operating in step S21, the filling of the coloring sensitive matter 7 is not carried out.

This is why there is a possibility that the air bubble is generated within the tank 40 due to the supply of the coloring sensitive matter 7 to the ante-pump tank 40 and it is necessary to certainly exclude the fear that the generated air bubble is taken into the pump 25. The coloring sensitive matter 7 may be filled despite the pump 25 is operating or not by setting a margin on the lower limit position of the liquid level so that such fear has been excluded.

The present invention is not limited to the above described mode and the present invention may be effected in various modes. For example, the sensor is not limited to the electrostatic capacity type proximity sensor but a photoelectric sensor or the like may be used to monitor the change of the liquid level. Alternatively, the present intention is not limited to the example that the amount of the solution stored in the middle tank is decided by its liquid level and it may be decided whether the solution stored in the middle tank is not less than the lower limit value or not by various physical amounts (for example, a mass) in association with a cubic volume of the solution.

As described above, according to the present invention, the middle tank is provided on the way of a flow path connecting respective sources of supply and the applying device and the sensor detects that the amount of the solution is lower than a predetermined lower limit value during respective middle tanks are being used, so that the processing in association with the switching of the sources of supply is performed. Therefore, as preventing the air bubbles from mixing in the solution to be provided to the applying device, it is possible to use the solution within the tank effectively than ever.

What is claimed is:

1. A device for providing a solution which leads a solution from any one of sources of supply to an applying device via a predetermined flow path, comprising:

a middle tank which is provided on the way of the flow path connecting each of the sources of supply and the applying device for each of the sources of supply;

a sensor which detects whether an amount of a solution stored in each middle tank is not less than a predetermined lower limit value or not and outputs a signal in association with a detection result; and a controlling device which discriminates whether the amount of the solution stored in each middle tank is not less than the lower limit value or not on the basis of the output signal from the sensor and performs the predetermined processing in association with switching of the sources of supply when it is decided that the amount of the solution stored in the middle tank is less than the lower limit value, wherein the applying device is provided with a pump repeating a process to take in the solution by a predetermined amount and a process to discharge the solution which is taken in;

wherein an ante-pump tank for storing the solution to be provided to the pump is provided between the middle tank and the pump as well as downstream of a position where flow paths from each middle tank are converged;

wherein the ante-pump tank is provided with a sensor for a pump which detects whether the amount of the solution which is stored in the ante-pump tank is not less than a predetermined lower limit value or not and outputs a signal in association with detection result; and wherein the controlling device discriminates whether the amount of the solution which is stored in the ante-pump tank is not less than the lower limit value or not and if the controlling device decides that the amount of the solution which is stored in the ante-pump tank is less than the lower limit value, predetermined processing in association with filling of the solution from the middle tank to the ante-pump tank is carried out.

2. The device for providing a solution according to claim 1, wherein the controlling device prohibits the filling of the solution from the middle tank to the ante-pump tank during the pump is operating.

* * * * *